US007746732B2

(12) United States Patent
Chritin et al.

(10) Patent No.: US 7,746,732 B2
(45) Date of Patent: Jun. 29, 2010

(54) GONG, MORE PARTICULARLY FOR HOROLOGICAL MOVEMENT

(75) Inventors: Vincent Chritin, Cessy (FR); Eric Van Lancker, Chavannes-des-Bois (CH)

(73) Assignee: Richemont International S.A., Villars-sur-Glane (CH)

( * ) Notice: Subject to any disclaimer, the term of this patent is extended or adjusted under 35 U.S.C. 154(b) by 0 days.

(21) Appl. No.: 11/868,973

(22) Filed: Oct. 9, 2007

(65) Prior Publication Data

US 2009/0091431 A1 Apr. 9, 2009

(51) Int. Cl.
*G04B 21/00* (2006.01)

(52) U.S. Cl. ..... 368/243

(58) Field of Classification Search ..... 368/75, 368/243, 269–271, 315; 116/152, 162
See application file for complete search history.

(56) References Cited

U.S. PATENT DOCUMENTS

| | | | | |
|---|---|---|---|---|
| 1,942,811 | A * | 1/1934 | Green | 340/397.1 |
| 2,269,098 | A * | 1/1942 | Garnett | 340/392.1 |
| 2,903,365 | A * | 9/1959 | O'Brian et. al. | 426/5 |
| 7,280,440 | B2 * | 10/2007 | Goeller et al. | 368/75 |
| 7,292,505 | B2 * | 11/2007 | Schmiedchen | 368/110 |

FOREIGN PATENT DOCUMENTS

| | | |
|---|---|---|
| CH | 649166 | 4/1985 |
| EP | 1715393 A1 | 10/2006 |
| EP | 1760549 A1 | 3/2007 |
| WO | WO2006095244 | 9/2006 |

OTHER PUBLICATIONS

Abrate, Serge, Vibration of Non-Uniform Rods and Beams, Journal of Sound and Vibration, 1995, 703-716, 185(4), Academic Press Limited.

Kang, Jae-Hoon et Ali, Three-dimensional vibration analysis of thick, tapered rods and beams with circular cross-section, International Journal of Mechanical Sciences, 2004, 929-944, Elsevier Ltd.

Lee, S.Y. et al, Free in-plane vibrations of curved nonuniform beams, Acta Mechanica, 2002, 173-189, 155, Springer-Verlag.

Mabie, H.H. et al, 1971 Transverse Vibrations of Double-Tapered Cantilever Beams, 1972, The Journal of the Acoustical Society of America, 1771-1774, 51(5).

Wang, Han-Chung et al, Tables of Natural Frequencies and Nodes for Transverse Vibration of Tapered Beams, 1966, NASA Contractor Report, Prepared under Grant No. NsG-434 by University of Illinois for National Aeronautics and Space Administration, Washington, D.C.

* cited by examiner

*Primary Examiner*—Edwin A. Leon
(74) *Attorney, Agent, or Firm*—Young & Thompson

(57) ABSTRACT

A gong for a striking mechanism in a horological movement comprises a first end mounted to a heel and a second end that is free. The first end and the second end define a longitudinal axis along the length of the gong, wherein the gong has a cross-section size that is variable along all or part of its longitudinal axis including an end section of the gong that comprises the free end.

19 Claims, 1 Drawing Sheet

GONG, MORE PARTICULARLY FOR HOROLOGICAL MOVEMENT

TITLE OF THE INVENTION

BACKGROUND OF THE INVENTION

The object of the present invention is a gong, more particularly a gong used in a striking mechanism (or striking works) of a horological movement such as those used in watches having minute repeaters, small and grand strikes, and alarms.

DESCRIPTION OF THE RELATED ART

In a general way, the mechanisms that produce the sound emission function in a striking mechanism must realize the four sub-functions of excitation, frequency selection, structure-borne vibratory transmission, and acoustic radiation. In known striking mechanisms, excitation is realized by one or several hammers and their actuating systems where these hammers hit one or several gongs fastened inside the watch by way of a heel. The gong (or gongs) realizes the frequency selection function by vibrating at a range of frequencies among which the audible ones will tune the emitted sound to a certain perceived pitch level. The vibratory transmission function is realized by materials selection, geometries, and by the design of the interfaces between the gong or gongs, their heels, and the element of the watch movement or case to which the heel or heels are fastened. Finally, the acoustic radiation function is realized by the part or parts of the watch case, generally the back or crystal, which convert the parietal vibrations to the ambient air as audible acoustic pressures.

SUMMARY OF THE INVENTION

It is the aim of the present invention, to improve the quality of the sound emitted by a striking mechanism, more precisely, the perceived pitch selectivity, richness, amplitude, and, in the case of two or several gongs, the inter-gongs tone homogeneity. To this end, the present invention aims to improve the gong or gongs used in a striking mechanism, and also at improving the transmission of the vibrations of said gong to its heel.

BRIEF DESCRIPTION OF THE DRAWINGS

The annexed drawing illustrates in a schematic and exemplary way several embodiments of a gong according to the invention.

DESCRIPTION OF THE PREFERRED EMBODIMENT

Figure 1:
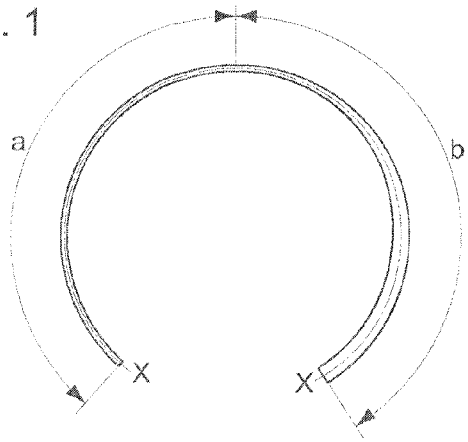
FIG. 1 is a top view of a gong extending as a circular arc or spiral.

It is a particular aim of the present invention to realize a gong with harmonic components, or non-integer multiples in given pre-defined ratios, in a frequency range of interest such that the sound emitted by this gong is subjectively very well defined, generally perceived as the same sound by different users or persons, and, in the case of two or several gongs, with high level inter-gongs tuning.

In prior art gongs, the so-called harmonics of the fundamental frequency, that are located within the range of useful audible frequencies, are partial, rather than integral, multiples of the fundamental frequency (these are hereinafter referred as "partials"). For this reason, the sound emitted by such prior art gongs is generally not a harmonic sound. As a result, the individual sound pitch of a given gong is not perceived in identical fashion by all people, and, when two or more gongs strike successively, imprecise tuning is subjectively felt.

The aim of the present invention is to realize, in a frequency range of interest, a gong with pre-defined ratio components, or, identically, in the case of integer ratios, with strictly harmonic components, such that the overall pitch of the sound (i.e., the amplitude and phase composition of these components) is preferably within a margin of typically 5 cents of the desired partial or integer ratio of the fundamental targeted pitch tone vibration frequency of the gong (depending the materials and geometrical contingencies there are typically about live to ten of these in the frequency range of interest). As will be appreciated by those skilled in the art, a cent is a unit of pitch where one equal tempered semitone equals 100 cents and one octave equals 1200 cents.

The present inventors have determined that in order to provide a gong with such determined components in the frequency range of interest, it is highly advantageous for the size of the gong's cross-section to vary along at least an end section of the gong's longitudinal axis (i.e., along its length). The "size" of the cross section refers to the area of the cross-section at any particular point along the gong's length.

By varying the size of the cross-section of the gong along all or part of the gong's longitudinal axis including at least an end section, and in particular with the size of the gong's cross-section preferably increasing in the direction toward the free end of the gong, it is possible to create a family (a set) of audibly dominant partials or harmonics, and thus to obtain a strictly tonally controlled sound. The specific nature or degree of the variation in the dimensions (including possibly its shape) of the gong's cross section over its length can be optimised for a desired audible tone, at a given pitch, by employing standard dynamic finite-element simulation software tools to calculate the vibrational behavior of a gong with given geometry, materials and mounting conditions, Such a tool can then be used to iteratively vary one or more parameters (e.g., diameter, length, width) of the gong's cross-section. Subsequently, a gong having the desired geometry can be manufactured by means of standard machining.

In accordance with a first embodiment, FIG. 1 illustrates a gong in the shape of a circular arc or spiral having a cross-section size that is constant over a first section a of its length and then increases over a second end section b of its longitudinal axis or length x-x. As seen in FIG. 1, end section b includes (and effectively terminates at) the free end of the gong. Preferably, end section b has a length that is at least two-thirds of the entire length of the gong.

Figures 4, 5, 6, 7, 8:
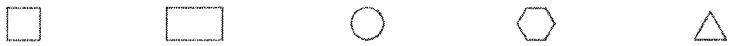
FIGS. 4 to 8 illustrate by way of example various cross-sections of gongs showing that different section shapes may be employed.

In a variant of this embodiment, the size of the cross-section may also vary over the first section a. The cross-section of such a gong may be circular (as illustrated in FIG. 6) or polygonal, for e.g., square, rectangular, octagonal, or triangular (as illustrated in FIGS. 4, 5, 7, and 8 respectively).

Figure 2:
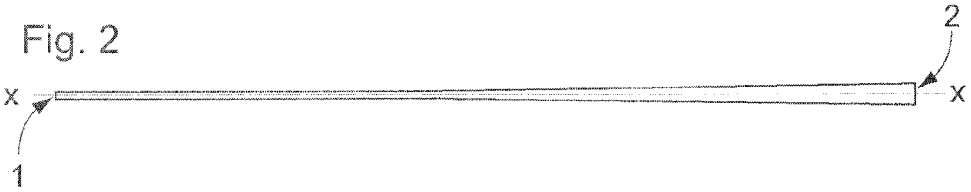
FIG. 2 is a top view of a straight gong.

FIG. 2 illustrates an essentially straight-line gong with a cross-section size that increases from its mounted end 1 to its free end 2 in accordance with a second embodiment. In a variant of this embodiment, the size of the cross-section may instead only vary over a section of the gong that includes free end 2. Here again the shape of the gong's cross section may be circular or polygonal.

In each of the above embodiments, one can define β as the ratio of the size of the cross section at the free end of the gong to the size of the cross-section at the point on the going where the variable cross-section size begins (i.e., the beginning of the end section). In a preferred embodiment, the size ratio β is at least equal to 2, and in a more preferred embodiment β is at least equal to 4; however it will be appreciated that β is by no means necessarily an integer and this ratio will vary depending on the specifics of the acoustic application. In addition, the rate of increase of cross-sectional size along the longitudinal axis (or the end section) of a gong may be constant (as shown in FIGS. 1 and 2) or this rate may also vary (see FIG. 9).

In the above described embodiments, the shape of the gong's cross section remains the same, however in other embodiments, the gong's cross-section may additionally change its shape along the gong's longitudinal axis x-x, for instance by passing from a circular to an elliptical section or conversely.

Figure 9:
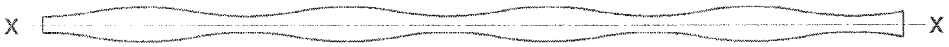
FIG. 9 illustrates a further variant of a gong according to the invention.

As a further embodiment, illustrated in FIG. 9, the gong's cross-section may repeatedly increase and then decrease in size along the gong's x-x axis. Likewise, the shape of the cross section may also change repeatedly along this x-x axis of the gong.

In accordance with the invention, the specific dimensions given to the gong's cross-section along its longitudinal x-x axis are chosen to vary in such a way so as to induce a family of frequency components that are in desired ratios or harmony with each other within the audible frequency range of interest. As indicated above, in a preferred embodiment, these variations in the gong's cross-section can be designed and optimised so that the emitted sound (which consists of several different frequency components—generally about from five to ten) meets strict acoustic quality parameters, preferably that each of the partials is within 5 cents of the desired ratio or integral multiple of a fundamental pitch frequency, while the overall frequency of the sound resulting from an amplitude and phase summation of these partials is a frequency having a value within 5 cents of the frequency of the desired sound (i.e., the perceived pitch frequency of the gong).

Figure 3:
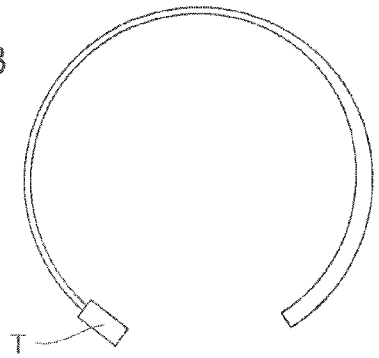
FIG. 3 illustrates the gong of FIG. 1 fabricated integrally with its heel.

As noted above, by selecting a desired perceived pitch frequency and applying the teachings of the present invention, one of ordinary skill in the art using a standard finite-element calculation tool can readily arrive at a specific gong design that meets such required acoustic quality parameters (such as those just mentioned above). For example, a gong with the profile illustrated in FIG. 3 profile may present five consecutive partials of interest under a constant ratio, compared to the variable ratios that a similar gong with a constant cross-section throughout its length would exhibit. In the resulting design, the variation of the shape and/or surface area of the gong's cross section along its longitudinal x-x axis, effectively produces integral ratios between the useful—that is, the audible—vibration frequencies of the gong.

In accordance with other variants, the size of the gong's cross-section may rise in the direction of its free end towards the heel onto which it is mounted; however an increase in the direction towards the free end of the gong is strongly preferred.

Finally, all variants of the gong according to the invention may be fabricated integrally with the heel T (FIG. 3), so that the transmission of the gong's useful vibrations to the heel T is improved.

The invention claimed is:

1. A gong for a striking mechanism in a horological movement in which the gong vibrates when hit by a hammer, the gong comprising a first end mounted to a heel and a second end that is free, the first end and the second end defining a longitudinal axis along the length of the gong, wherein the gong has a cross-section size that is variable along all or part of its longitudinal axis including an end section of the gong comprising the free end, the gong vibrating when hit by a hammer and thereby resulting vibrations realizing a sound emission function, wherein the size of the cross-section increases along said end section in the direction toward the free end of the gong.

2. The gong according to claim 1, wherein the rate of increase in the size of the cross-section along said end section is constant.

3. The gong according to claim 1, wherein the shape of the gong's cross section varies along said end section.

4. The gong according to claim 1, wherein the longitudinal axis of the gong is essentially straight.

5. The gong according to claim 1, wherein the longitudinal axis of the gong is a circular arc or spiral.

6. The gong according to claim 1, wherein the gong is fabricated integrally with a heel with said heel providing the first end.

7. The gong according to claim 1, wherein the end section has a length equal to at least two-thirds of the entire length of the gong.

8. The gong according to claim 1, wherein the size of the cross section at the free end of the gong is β times larger than the size of the cross-section at a point on the gong where the end section begins, where β is at least equal to 2.

9. The gong according to claim 8, wherein β is at least equal to 4.

10. The gong according to claim 1, wherein the shape of the gong's cross section is the same along said end section.

11. The gong according to claim 10, wherein the shape of the gong's cross section is circular along said end section.

12. The gong according to claim 1, wherein when the gong is excited, the vibrations of the gong comprise a set of components each of which has a frequency that is within a margin of 5 cents of a desired partial or integer ratio of the fundamental targeted pitch tone vibration frequency of the gong.

13. The gong according to claim 12, wherein an amplitude and phase summation of the frequencies in the set of components corresponds to a frequency that is within 5 cents of a pre-determined non-integral or integral multiple of a desired perceived pitch frequency of the gong.

14. A gong for a striking mechanism in a horological movement in which the gong vibrates when hit by a hammer, the gong comprising a first end mounted to a heel and a second end that is free, the first end and the second end defining a longitudinal axis along the length of the gong, wherein the gong has a cross-section size that is variable along all or part of its longitudinal axis including an end section of the gong comprising the free end, the gong vibrating when hit by a hammer and thereby resulting vibrations realizing a sound emission function, and wherein the size of the cross-section increases and decreases repeatedly along all or part of its longitudinal axis including said end section.

15. A gong for a striking mechanism in a horological movement, the gong comprising a first end mounted to a heel and a second end that is free, the first end and the second end defining a longitudinal axis along the length of the gong, the gong comprising one or more sections including an end section comprising the free end, and wherein along said end section the size of the cross-section of the gong increases in the direction toward the free end of the gong, the gong vibrating when hit by a hammer and thereby resulting vibrations realizing a sound emission function, wherein the size of the cross-section increases along said end section in the direction toward the free end of the gong.

16. The gong according to claim 15, wherein the size of the cross-section increases at a constant rate along said end section.

17. The gong according to claim 15, wherein the end section of the gong has a length equal to at least two-thirds of the entire length of the gong.

18. The gong according to claim 15, wherein the size of the cross section at the free end of the gong is $\beta$ times larger than the size of the cross-section at a point on the gong where the end section begins, where $\beta$ is at least equal to 2.

19. The gong according to claim 15, wherein the cross-section has a circular shape along the end section of the gong.

* * * * *